US012492545B1

(12) United States Patent
Yin

(10) Patent No.: US 12,492,545 B1
(45) Date of Patent: Dec. 9, 2025

(54) NON-RETURN DEVICE FOR PIPELINE PORT

(71) Applicant: Shenzhen AiChong Industrial Co., Ltd., Shenzhen (CN)

(72) Inventor: Aicheng Yin, Shenzhen (CN)

(73) Assignee: Shenzhen AiChong Industrial Co., Ltd., Shenzhen (CN)

( * ) Notice: Subject to any disclaimer, the term of this patent is extended or adjusted under 35 U.S.C. 154(b) by 0 days.

(21) Appl. No.: 19/001,477

(22) Filed: Dec. 25, 2024

(30) Foreign Application Priority Data

Dec. 13, 2024 (CN) ..... 202423083564.4

(51) Int. Cl.
*E03F 7/06* (2006.01)

(52) U.S. Cl.
CPC ..... *E03F 7/06* (2013.01)

(58) Field of Classification Search
CPC .. E03F 7/06; E01F 5/005; E04D 13/08; E04D 2013/0806; E04D 2013/086; E04D 2013/0866
See application file for complete search history.

(56) References Cited

U.S. PATENT DOCUMENTS

| | | | | |
|---|---|---|---|---|
| 7,685,778 | B2 * | 3/2010 | Edell | E04D 13/08 52/12 |
| 8,006,720 | B1 * | 8/2011 | Kotansky | E04D 13/08 52/16 |
| 9,028,169 | B2 * | 5/2015 | DeLoach | E04D 13/08 52/16 |
| 9,238,916 | B2 * | 1/2016 | Schneider | E04D 13/08 |
| 2014/0208658 | A1 * | 7/2014 | Jelacic | E06B 7/28 29/557 |
| 2019/0153730 | A1 * | 5/2019 | Sager | E04D 13/076 |

* cited by examiner

*Primary Examiner* — Theodore V Adamos
(74) *Attorney, Agent, or Firm* — JEEN IP LAW, LLC

(57) ABSTRACT

Provided is a non-return device for a pipeline port, including a main body portion and a non-return portion. The main body portion is of a barrel-shaped structure provided with a channel, and the non-return portion is provided with a plurality of through holes, wherein the main body portion and/or the non-return portion is provided with a limiting structure, used to limit relative positions between the main body portion and the non-return portion. Provided with the limiting structure, the non-return device for a pipeline port provided by the present disclosure realizes mounting, fixation, and separation of the positions between the main body portion and the non-return portion and is conveniently disassembled and assembled. In addition, the non-return portion is not connected and fixed by arranging other connecting structures so the overall processing cost is relatively low.

5 Claims, 8 Drawing Sheets

NON-RETURN DEVICE FOR PIPELINE PORT

CROSS-REFERENCE TO RELATED APPLICATIONS

This application claims priority to Chinese Patent Application No. 202423083564.4, filed on Dec. 13, 2024, which is hereby incorporated by reference in its entirety.

TECHNICAL FIELD

The present disclosure relates to the technical field of building pipelines and particularly relates to a non-return device for a pipeline port.

BACKGROUND

Various buildings are provided with drain pipes for discharging sewage, domestic water, or rainwater. In order to prevent insects and mice from entering the building through the drain pipe, a non-return device will be arranged at a water outlet of the drain pipe, which does not affect the normal drainage function and may effectively prevent insects and mice from entering the drain pipe.

According to the non-return device in the prior art, a movable baffle is mainly arranged at the water outlet for treatment. The baffle and the pipeline are connected through a rotating shaft. When it is needed to drain, the baffle will be pushed away. When drainage is not needed, the baffle attaches the pipeline under the action of gravity. In the arrangement mode, one end of the baffle is fixedly connected to the pipeline through the rotating shaft so that the baffle is hardly disassembled and troublesome to replace. Moreover, insects and mice may open the baffle easily to enter into the pipeline, so the blocking effect is poor.

SUMMARY

The present disclosure provides a non-return device for a pipeline port to solve the problem of the device being hardly disassembled and the blocking effect being poor.

Provided is a non-return device for a pipeline port, including a main body portion and a non-return portion. The main body portion is of a barrel-shaped structure provided with a channel, and the non-return portion is provided with a plurality of through holes, wherein the main body portion and/or the non-return portion is provided with a limiting structure, used to limit relative positions between the main body portion and the non-return portion.

Compared with the prior art, according to the non-return device for a pipeline port provided by the present disclosure, by arranging the limiting structure on the main body portion and/or the non-return portion, a connecting structure is not additionally arranged, and mounting, fixation, and separation of positions between the main body portion and the non-return portion are only achieved. In this arrangement mode, the non-return portion and the main body portion may be conveniently separated so that the non-return portion can be smoothly disassembled or replaced. Moreover, the non-return portion is provided with a plurality of through holes to achieve drainage and anti-insect and mouse functions. Insects and mice can neither open the non-return portion nor enter the channel during drainage. In addition, the non-return device for a pipeline port is simple and skillful in overall structural design, and the non-return portion is not connected and fixed by arranging other connecting structures so the overall processing cost is relatively low.

BRIEF DESCRIPTION OF DRAWINGS

In order to describe the technical solutions in the embodiments of the present disclosure more clearly, the following briefly describes the accompanying drawings required for describing the embodiments. Apparently, the accompanying drawings in the following description show merely some embodiments of the present disclosure, and those of ordinary skill in the art may still derive other drawings from these accompanying drawings without making creative efforts.

DESCRIPTION OF EMBODIMENTS

Figure 1:
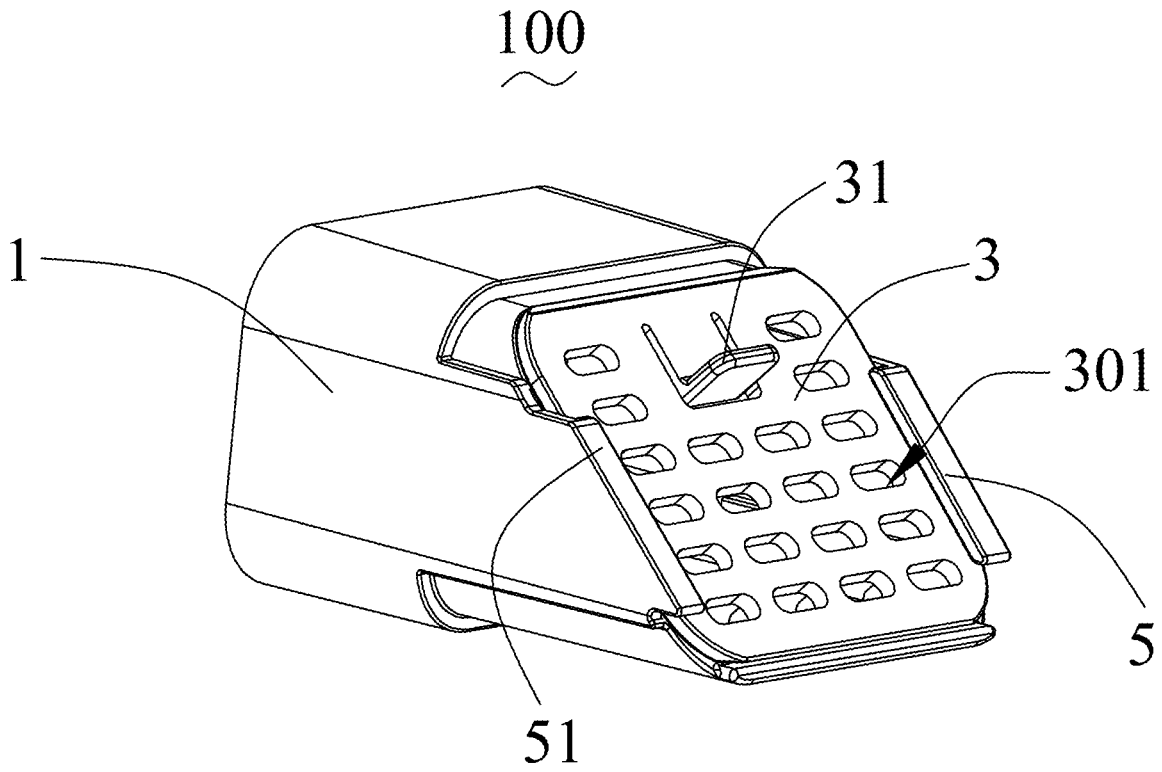
FIG. 1 is a three-dimensional schematic structural diagram of the first embodiment of a non-return device for a pipeline port provided by the present disclosure.

The following clearly and completely describes the technical solutions in the embodiments of the present disclosure with reference to the accompanying drawings in the embodiments of the present disclosure. Apparently, the described embodiments are some of the embodiments of the present disclosure rather than all of the embodiments. On the basis of the embodiments in the present disclosure, all other embodiments acquired by those of ordinary skill in the art without making creative efforts fall within the scope of protection of the present disclosure.

It should be noted that all directional indications (for example, upper, lower, left, right, front, back, and the like) in the embodiment of the present disclosure are merely used for explaining relative position relations, moving conditions, and the like among components in a certain special gesture (as shown in the drawings). If the special gesture changes, the directional indications change correspondingly.

In addition, descriptions such as "first" and "second" are merely used for a description purpose rather than being construed as indicating or implying relative importance or implicitly indicating the quantity of indicated technical features. Thus, features defining "first" and "second" may expressively or implicitly include at least one feature. In the description of the present disclosure, unless otherwise specified, "a plurality of" means at least two, for example, two, three and the like.

In the present disclosure, unless otherwise expressly stated and defined, the terms "connect", "fix" and the like shall be understood in a broad sense. For example, "fix" may be fixed connected or detachably connected, or integrally connected; they may be mechanically connected or electrically connected; they may be directly connected or connected via an intermediate, or they may communicate between two components insides or an interactive relation of the two components unless otherwise specified. Those of ordinary skill in the art may understand specific meaning of the terms in the present disclosure under specific circumstances.

In addition, the technical solutions of the embodiments of the present disclosure may be combined with one another based on implementation by those of ordinary skill in the art. When the technical solutions contradict each other in combination or may not be realized, it is to be considered that there is no combination of the technical solutions, which shall not fall into the protection scope of the present disclosure.

Figure 2:
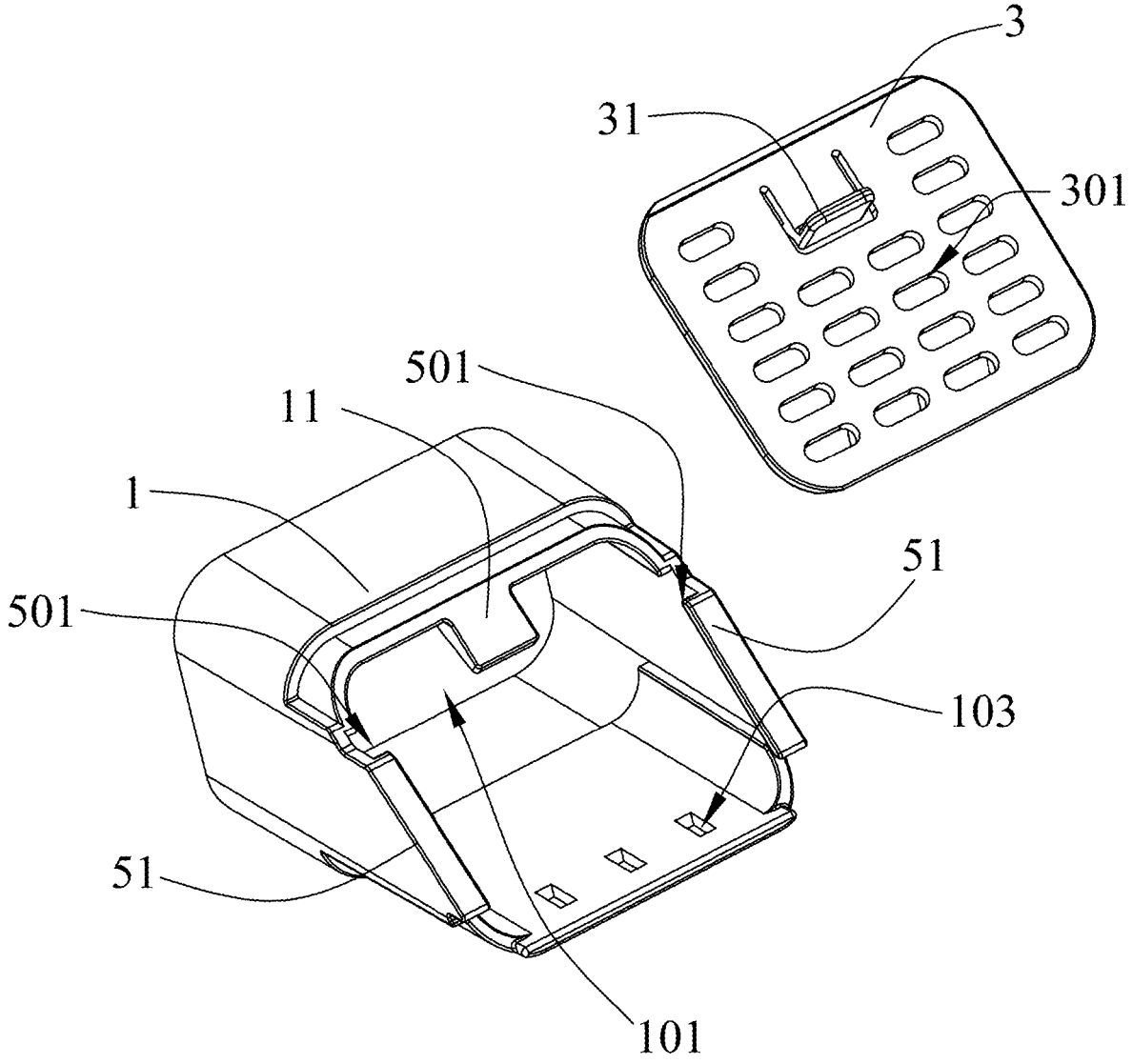
FIG. 2 is a three-dimensional structural exploded view of the non-return device for a pipeline port provided by the present disclosure.
Figure 3:
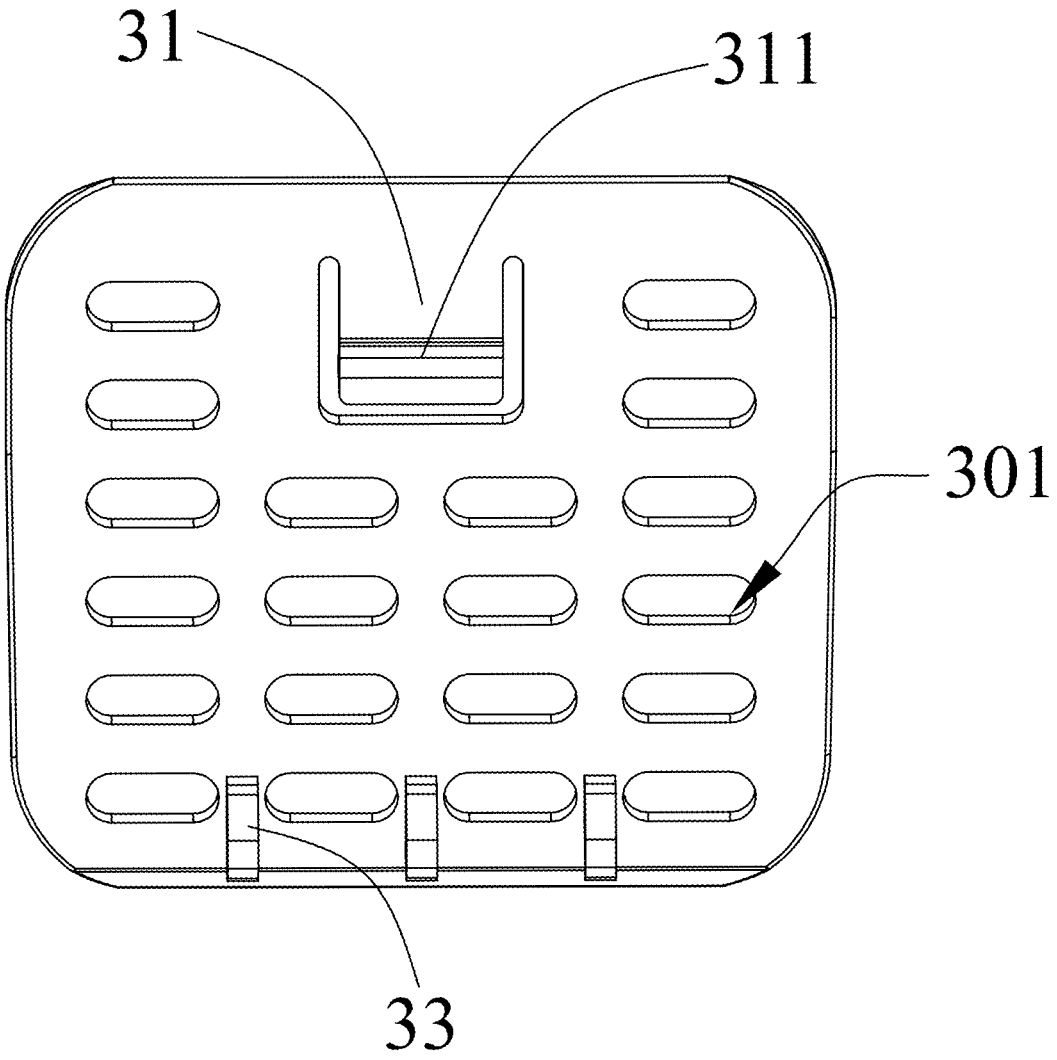
FIG. 3 is a three-dimensional structural diagram of the non-return portion shown in FIG. 2 from another perspective.

Referring to FIGS. 1-3, a non-return device for a pipeline port 100, assembled at the tail end of a pipeline (not shown in the figures) for drainage and insect and mouse prevention, including a main body portion 1 and a non-return portion 3. The main body portion 1 is of a barrel-shaped structure provided with channel 101, and the non-return portion 3 is provided with a plurality of through holes 301. The main body portion 1 and/or the non-return portion 3 is provided with a limiting structure 5, used to limit relative positions between the main body portion 1 and the non-return portion 3.

It should be noted herein that the main body portion 1 is of the barrel-shaped structure, which may also be of a cylindrical structure or a square barrel-shaped structure. A specific structure is determined according to the specific structure of the tail end of the pipeline, which is not limited herein. The main body portion 1 is used to connect the pipeline and drain water outward through channel 101. The embodiments in the present application are all described by taking the square barrel-shaped structure as an example, and the arrangement concept of the cylindrical structure is similar to that of the square barrel-shaped structure, which is not repeatedly described subsequently.

The limiting structure 5 may be independently arranged on the main body portion 1 or the non-return portion 3, or may match with each other to realize limitation by being arranged on the main body portion 1 or the non-return portion 3 in a combined manner. The non-return device for a pipeline port 100 realizes fixation and separation of the positions between the main body portion 1 and the non-return portion 3 through the limiting structure 5. The limiting structure 5 is arranged to effectively fix the position of the non-return portion 3, which limits insects and mice from entering channel 101 while realizing drainage. Moreover, the relative positions are stable, and during drainage, water may be discharged from through hole 301, and the non-return portion 3 will not be rushed by water. When it is needed to replace the non-return portion 3, it only needs to separate the non-return portion 3 from the main body portion 1 through the limiting structure 5, so that it is convenient to disassemble and the maintenance cost is relatively low.

In order to disassemble the non-return portion 3, the limiting structure 5 includes sliding grooves 501, the sliding grooves 501 are formed in both sides of the main body portion 1 or the non-return portion 3, and the non-return portion 3 and the main body portion 1 are slidably connected and mounted in a direction of the sliding grooves 501. In the first embodiment, the sliding grooves 501 are formed on both sides of the main body portion 1, the non-return portion 3 itself is equivalent to a slide block, and the non-return portion 3 slides in the direction of the sliding grooves 501 to be attached to the main body portion 1 or separated so that the whole device is conveniently disassembled.

It should be noted herein that the length of the sliding grooves 501 is not limited. Of course, the greater the length is, the better the stability is. The less the length is, the lower the stability is. The length may be set according to a specific demand. Moreover, there are various modes to form the sliding grooves 501. For example, in the first embodiment, "L"-shaped flanges 51 are inwardly arranged on both sides of the main body portion 1. The flanges 51 matches with the side wall of the main body portion 1 to form the sliding grooves 501. It is simple to process. The non-return portion 3 may be slidably mounted and fixed without arranging structures matching with each other.

Figure 4:
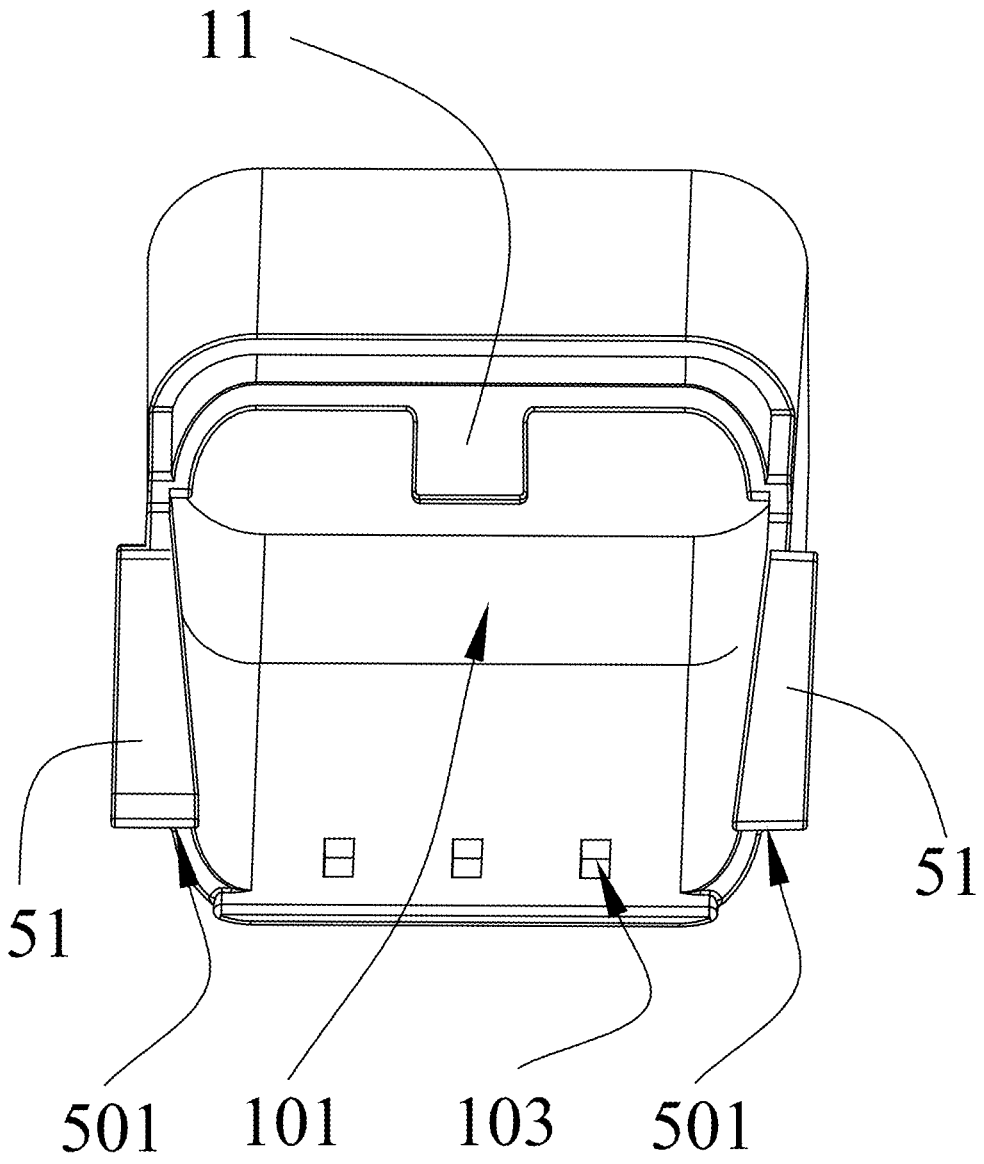
FIG. 4 is an enlarged view of the main body portion in a second embodiment of the non-return device for a pipeline port provided by the present disclosure.
Figure 5:
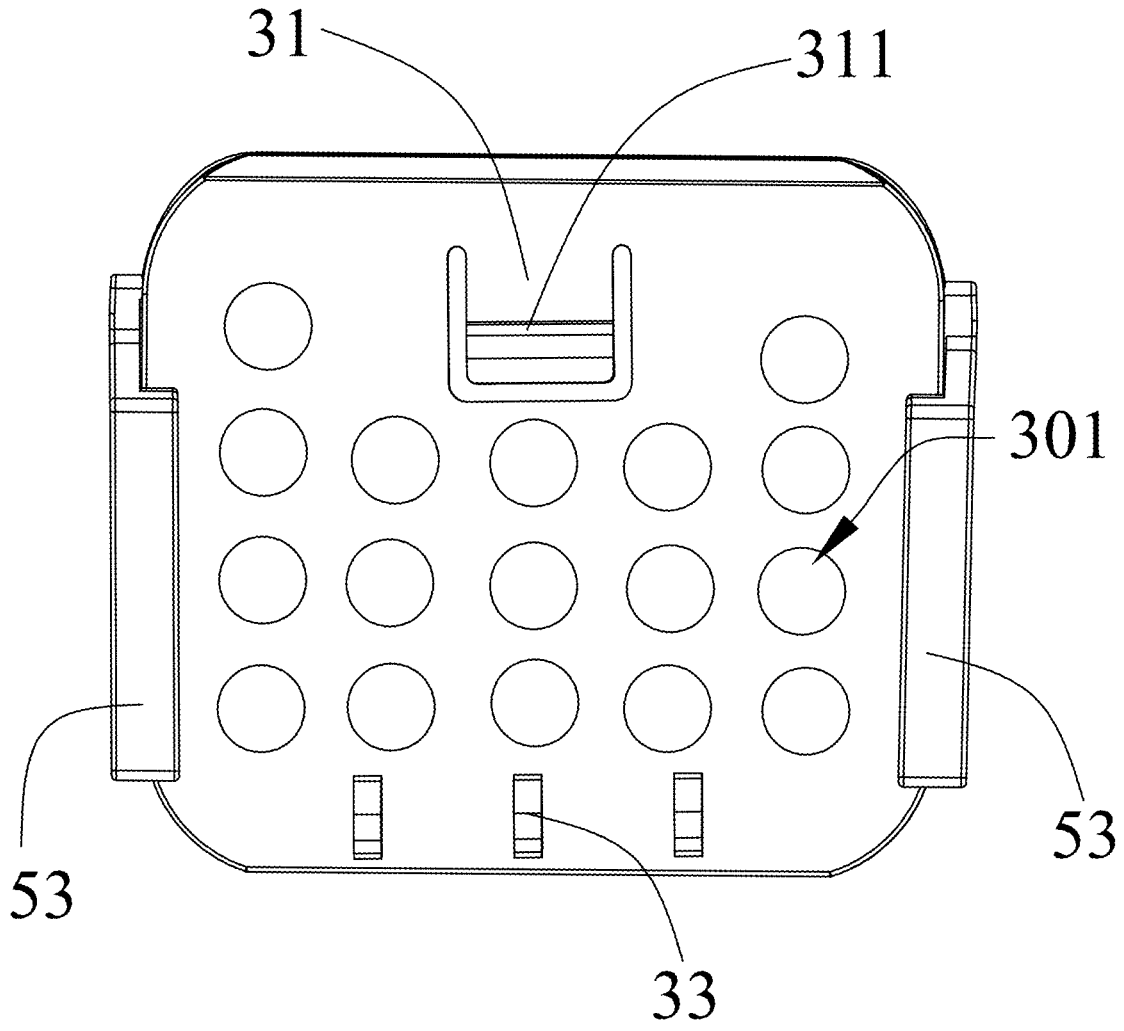
FIG. 5 is an enlarged view of the non-return portion in the second embodiment of the non-return device for a pipeline port provided by the present disclosure.

Of course, in another embodiment, the flanges 51 may also be outwardly arranged on both sides of the main body portion 1. FIG. 4 and FIG. 5 are, respectively, enlarged views of the main body portion 1 and the non-return portion 3 in the second embodiment. The flanges 51 are arranged on both sides of the main body portion 1. Correspondingly, sliding members 53 are arranged on both sides of the non-return portion 3. The sliding members 53 drive the non-return portion 3 to move while sliding on the sliding grooves 501, so as to realize slidable mounting and fixation. The sliding members 53 are arranged vertically to the body of the non-return portion 3 to form the sliding grooves 501 corresponding to the flanges 51. The flanges 51 may slide relative to the sliding grooves 501. In addition, continuously referring to FIG. 6, a gap 503 is formed between each of the sliding members 53 arranged on each side of the non-return portion 3 and the body of the non-return portion 3. The size of the gap 503 corresponds to the thickness of the flanges 51. The sliding grooves 501 are formed between the flanges 51 and the main body portion 1. The sliding members 53 may slide on the sliding grooves 501 to drive the non-return portion 3 to move. The flanges 51 are clamped between the sliding members 53 and the body of the non-return portion 3.

Figure 7:
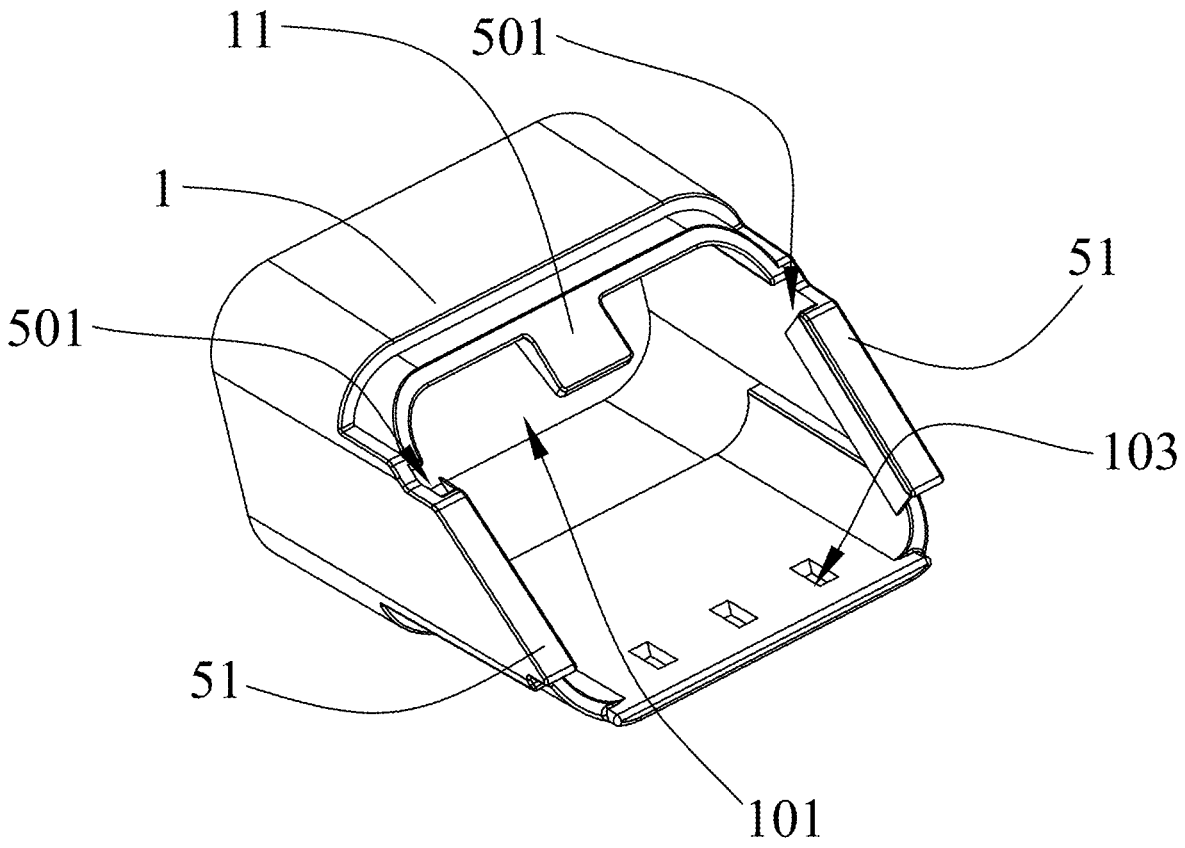
FIG. 7 is an enlarged view of the main body portion in a fourth embodiment of the non-return device for a pipeline port provided by the present disclosure.

Besides the "L"-shaped structure, each of the flanges 51 may also be arranged as an "n"-shaped structure correspondingly. FIG. 7 is an enlarged view of the main body portion 1 in the fourth embodiment. The flanges 51 and the non-return portion 3 in the third embodiment may match each other in use. Moreover, the "n"-shaped flanges 51 may also be arranged on both sides of the main body portion 1 to extend inward or outward as long as the size of the non-return portion 3 is correspondingly modified. The principle is similar, which is not described in detail herein. Compared with the "L"-shaped flanges 51, the "n"-shaped flanges 51 slidably abut against the sliding members 53 more sufficiently, so that the sliding members slide more smoothly.

Figure 8:
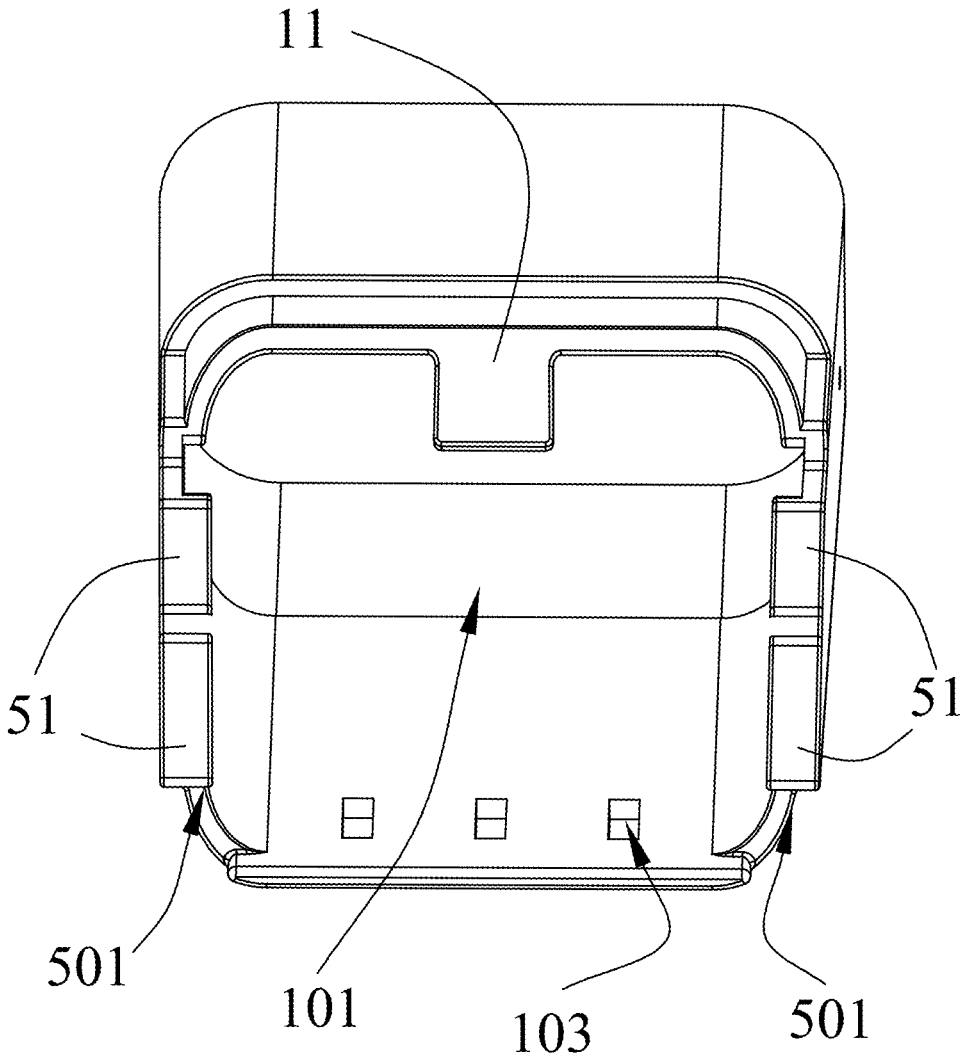
FIG. 8 is an enlarged view of the main body portion in a fifth embodiment of the non-return device for a pipeline port provided by the present disclosure.

Besides, the included angle between each of the flanges 51 and the main body portion 1 is not specifically limited. A vertically arranged solution is preferred, which facilitates processing and production. Moreover, flange 51 may be integrally and continuously arranged or arranged in sections. The sectional arrangement mode may effectively save the processing cost, and ensure formation of the slidably connected sliding grooves 501. FIG. 8 is an enlarged view of the main body portion 1 in the fifth embodiment. The flanges 51 are arranged in two sections, and the two flanges 51 are spaced, which may similarly realize sliding connection, so that the material between the two flanges 51 is saved and the production cost is lowered. Of course, the flanges may also be arranged in a sectional arrangement mode such as three or more sections, which is not limited herein.

Continuously referring to FIG. 2 and FIG. 3, to manually disassemble the non-return portion 3, the non-return portion 3 is provided with a control block 31. The control block 31 extends outward from the body of the non-return portion 3 to manually control the non-return portion 3 to move relative to the main body portion 1. Since the non-return portion 3 needs to be slidably disassembled relative to the main body portion 1, it needs to be manually controlled. The control block 31 extending outward is arranged on the non-return portion 3, so that an operator manually controls to push the control block 31, and the non-return portion 3 slides mutually. It is more labor-saving to operate.

In the above embodiment, a clamping block 11 may further be arranged at the top of the main body portion 1, and the control block 31 is provided with a first limiting bulge 311 relative to the clamping block 11. After the main body 1 and the non-return portion 3 are slidably mounted through the sliding grooves 501, the clamping block 11 and the first limiting bulge 311 matches with each other to further stabilize the relative positions between the non-return portion 3 and the main body portion 1. Correspondingly, the control block 31 may move relative to the non-return portion 3 in a vertical direction. The control block 31 is provided with the first limiting bulge 311, so that the clamping block 11 and the first limiting bulge 311 may be controlled in a clamped manner while the non-return portion 3 is slidably controlled. When it is needed to mount the non-return portion 3, the control block 31 is pinched to control the non-return portion 3 to slide to a preset position. In this case, the first limiting bulge 311 and the clamping block 11 are clamped and fixed. The non-return portion 3 cannot be detached along the sliding grooves 501. When it is needed to detach the non-return portion 3, the control block 31 is pinched to move in a direction vertical to the non-return portion 3, the clamping block 11 is separated from the first limiting bulge 311, and the control block 31 is continuously pinched to control the non-return portion 3 to slide in the direction of the sliding grooves 501 till the non-return portion 3 is separated from the main body portion 1. The device is simple and skillful. The non-return portion 3 is fixed in position and slidably disassembled by using the control block 31. By making full use of space and force, it is convenient to operate and relatively low in cost.

In order to further fix the mounting position of the non-return portion 3, a slot 103 is formed in the bottom of the main body portion 1, the non-return portion 3 is provided with a second limiting bulge 33 relative to the slot 103, and when the non-return portion 3 is mounted at a preset position relative to the main body portion 1, the second limiting bulge 33 is inserted into the slot 103. When the non-return portion 3 is mounted at the preset position, both sides are fixed in position through the flanges 51, the top is fixed through the clamping block 11 and the first limiting bulge 311, and the bottom is fixed in position through the second limiting bulge 33 and the slot 103. In this arrangement mode, the non-return portion 3 is fixed in position from a plurality of directions, which effectively ensures that the position of the non-return device for a pipeline port 100 will not be changed in the drainage process and insects and mice are prevented from entering the device. It should be noted herein that the numbers of the second limiting bulge 33 and the slot 103 correspond, which are not specifically limited, preferably three second limiting bulges and slots. Full action of the force may be ensured, and the device is hardly damaged.

Besides, the limiting structure 5 may further include a screw or a bolt (not shown in the figures) for fastening the non-return portion 3 and the main body portion 1. Except for the way of arranging the sliding grooves 501, the non-return portion 3 and the main body portion 1 may be fixedly connected by independently arranging the screw or bolt directly, so that the device is convenient to disassemble. Of course, screws or bolts may also be increased on an existing structure basis, so that the connection is more stable. For example, the screws or bolts are arranged on the flanges 51 or the sliding members 53 or between the control block 31 and the clamping block 11, which all can enhance the connecting effect between the non-return portion 3 and the main body portion 1.

Figure 6:
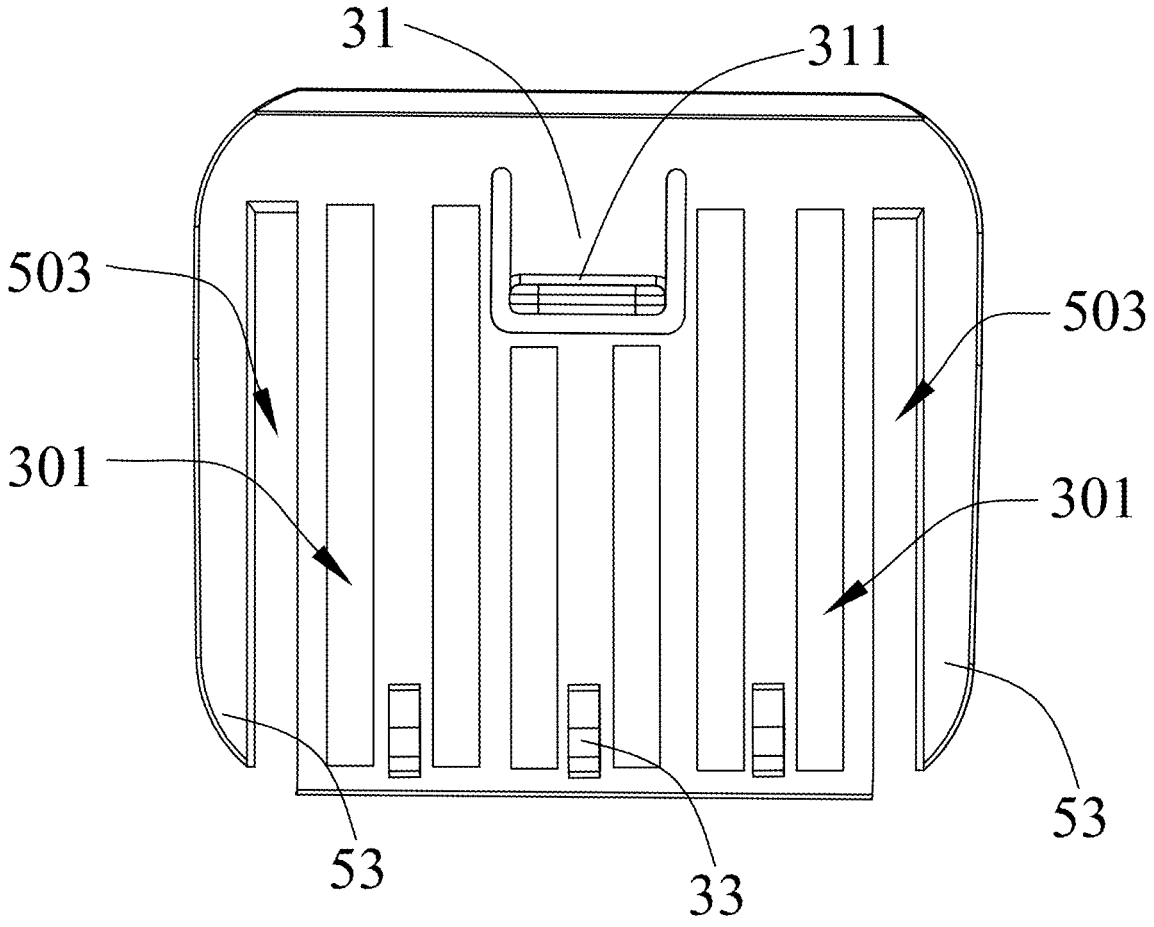
FIG. 6 is an enlarged view of the non-return portion in a third embodiment of the non-return device for a pipeline port provided by the present disclosure.

Continuously referring to FIG. 3, FIG. 5, and FIG. 6, the non-return portion 3 is provided with the through hole 301, which may have different structural shapes such as the square hole shape in the first embodiment, the round hole shape in the second embodiment or the strip-shaped structure in the third embodiment. The through hole is mainly used to prevent insects and mice from entering channel 101 while draining water. The through hole 301 and the channel 101 are arranged correspondingly. The size of the through hole 301 may also be set according to an actual demand, which is not described in detail herein.

Compared with the prior art, according to the non-return device for a pipeline port 100 provided by the present disclosure, by arranging the limiting structure 5 on the main body portion 1 and/or the non-return portion 3, a connecting structure is not additionally arranged, and mounting, fixation, and separation of positions between the main body portion 1 and the non-return portion 3 are only achieved. In this arrangement mode, the non-return portion 3 and the main body portion 1 may be conveniently separated so that the non-return portion 3 is smoothly disassembled or replaced. The non-return portion 3 is provided with the plurality of through holes 301 to achieve drainage and anti-insect and mouse functions. Insects and mice can neither open the non-return portion 3 nor enter channel 101 during drainage. The non-return device for pipeline port 100 is simple and skillful in overall structural design, and the non-return portion 3 is not connected and fixed by arranging other connecting structures so the overall processing cost is relatively low.

The above is merely an exemplary implementation of the present disclosure. It should be noted that those of ordinary skill in the art may make improvements without departing from the concept of the present disclosure and the improvements shall fall within the protection scope of the present disclosure.

What is claimed is:

1. A non-return device for a pipeline port, assembled at a tail end of a pipeline for drainage and insect and mouse prevention, comprising:

a main body portion, the main body portion being of a barrel-shaped structure provided with a channel; and a non-return portion, the non-return portion being provided with a plurality of through holes, wherein the main body portion and/or the non-return portion is provided with a limiting structure, used to limit relative positions between the main body portion and the non-return portion;

wherein the non-return portion is provided with a control block, and the control block is extended outward from a body of the non-return portion located within the non-return portion for manually controlling the non-return portion to move relative to the main body portion;

a clamping block is arranged at a top of the main body portion, and the control block is provided with a first limiting bulge relative to the clamping block;

wherein the control block moves relative to the non-return portion in a vertical direction, the clamping block and the first limiting bulge are controlled in a clamped manner and the non-return portion is slidably controlled;

wherein the limiting structure comprises sliding grooves, the sliding grooves are formed on both sides of the main body portion or the non-return portion, and the main body portion and the non-return portion are slidably connected and mounted in a direction of the sliding grooves;

wherein the limiting structure comprises flanges, when the sliding grooves are formed on both sides of the main body portion, the flanges are arranged on both sides of the main body portion, and the flanges match with a side wall of the main body portion to form the sliding grooves;

"L"-shaped flanges are inwardly arranged on both sides of the main body portion; each of The flanges and the main body portion are integrated and set vertically with the main body portion;

wherein a slot is formed in a bottom of the main body portion, the non-return portion is provided with a second limiting bulge relative to the slot;

when the non-return portion is mounted at a preset position relative to the main body portion, the second limiting bulge is inserted into the slot.

2. The non-return device for a pipeline port according to claim 1, wherein the limiting structure further comprises sliding parts, when the sliding grooves are formed on the non-return portion, the sliding parts are arranged on both sides of the non-return portion, and the sliding parts match with the body of the non-return portion to form the sliding grooves.

3. The non-return device for a pipeline port according to claim 2, wherein a gap is formed between each of the sliding parts and the body of the non-return portion relative to each of the flanges, and each of the flanges is clamped between each of the sliding parts and the body of the non-return portion.

4. The non-return device for a pipeline port according to claim 1, wherein the limiting structure comprises a screw or a bolt for fastening the non-return portion and the main body portion.

5. The non-return device for a pipeline port according to claim 1, wherein the main body portion is of a cylindrical structure or a square barrel-shaped structure, and each of the through holes is of a round hole-shaped, square hole-shaped, or strip-shaped structure.

* * * * *